United States Patent [19]

Leikhim

[11] 4,116,849

[45] Sep. 26, 1978

[54] THICKENED BLEACH COMPOSITIONS FOR TREATING HARD-TO-REMOVE SOILS

[75] Inventor: John William Leikhim, Cincinnati, Ohio

[73] Assignee: The Procter & Gamble Company, Cincinnati, Ohio

[21] Appl. No.: 777,191

[22] Filed: Mar. 14, 1977

[51] Int. Cl.[2] ..... C11D 7/54; C11D 7/56

[52] U.S. Cl. ..... 252/103; 252/95; 252/135; 252/187 H; 8/108 A; 134/2; 134/39; 134/40

[58] Field of Search ..... 252/94, 95, 99, 103, 252/135, 187 RH, 317; 8/108; 424/149; 134/2, 39, 40

[56] References Cited

U.S. PATENT DOCUMENTS

| | | | |
|---|---|---|---|
| 3,591,416 | 7/1971 | Johnson | 134/39 X |
| 3,630,923 | 12/1971 | Simmons et al. | 252/99 |
| 3,655,582 | 4/1972 | Dupre et al. | 134/2 X |
| 3,671,440 | 6/1972 | Sabatelli et al. | 252/99 X |
| 3,672,821 | 6/1972 | Schussler | 134/2 X |
| 3,684,722 | 8/1972 | Hynam et al. | 252/99 X |
| 3,697,431 | 10/1972 | Summerfelt | 134/2 X |
| 3,843,548 | 10/1974 | James | 252/187 H |
| 3,928,065 | 12/1975 | Savino | 134/39 X |
| 4,011,172 | 3/1977 | Marsan et al. | 252/99 X |

*Primary Examiner*—Mayer Weinblatt
*Attorney, Agent, or Firm*—Edmund F. Gebhardt; Richard C. Witte; Thomas H. O'Flaherty

[57] ABSTRACT

Highly alkaline thickened aqueous liquid hypohalite compositions, preferably thickened with a clay, preferably thixotropic, and preferably containing an alkali metal silicate can be used in a process for cleaning kitchen utensils having baked-on soils comprising the steps of treating a soiled utensil surface with the thickened alkaline hypohalite composition and then covering the treated soiled utensil surface with an excess of water at a temperature of more than about 100° F. The preferred compositions, free of abrasives, containing clay and an alkali metal silicate are particularly stable; provide good corrosion protection to metals, and are milder to skin than normal alkaline hypohalite compositions.

11 Claims, No Drawings

THICKENED BLEACH COMPOSITIONS FOR TREATING HARD-TO-REMOVE SOILS

BACKGROUND OF THE INVENTION

This invention relates to compositions for pretreating kitchen housewares, especially pots, pans, dishes, etc. which are soiled with hard-to-remove food soils and a process for treating said soils. Many of these housewares are made of aluminum which is particularly subject to attack by hypochlorite and alkalinity. Moreover, many housewares will be damaged if they are treated with abrasive materials.

Thickened hypochlorite compositions are known having been taught in U.S. Pat. Nos. 3,843,548; 3,558,496; 3,684,722; and 4,005,027. However, none of the above patents discloses applicant's particular process or applicant's preferred alkaline, abrasive-free, hypohalite compositions containing both a clay and an alkali metal silicate.

The use of bleaches in cleaning housewares is known, having been taught in U.S. Pat. Nos. 3,928,065; 3,708,429; 3,058,917; and 3,671,440.

Other patents disclosing bleaching compositions containing clays or silicas include U.S. Pat. Nos. 3,634,273; 1,600,845; 3,393,153; and 3,697,431.

All of the above-mentioned patents are incorporated herein by reference. However, none of the above references teach either applicant's process or applicant's preferred stable compositions.

SUMMARY OF THE INVENTION

The invention provides a preferred alkaline aqueous liquid hypohalite composition which is free of abrasives having a pH of from about 9 to about 13, containing from about ¼% to about 20% of a clay thickening and corrosion protection agent and from about ½% to about 9% of an alkali metal silicate having an $SiO_2$:$M_2O$ ratio greater than about 1 wherein M is selected from the group consisting of sodium and potassium; the hypohalite concentration giving from about ½% to about 10% available halogen; and said composition having a viscosity of from about 100 CPS to about 1,000,000 CPS.

The invention also provides a process for cleaning housewares soiled with hard-to-remove food soil comprising the steps of (1) applying a thickened alkaline aqueous liquid hypohalite composition having a pH of from about 9 to about 13; a hypohalite concentration of from about 1% to about 10%; and a viscosity of from about 100 CPS to about 1,000,000 CPS to the hard-to-remove soil and thereafter in step (2) covering said treated soil with an excess of water at a temperature of more than about 100° F.

DETAILED DESCRIPTION OF THE INVENTION

The hypohalite bleach component is present in the compositions of this invention in an amount to provide available halogen, e.g., chlorine, ranging from about ½% to about 10%, preferably from about 1% to about 6% and most preferably from about 2% to about 5%.

The bleach component can be any compound capable of liberating hypohalite such as hypochlorite and/or hypobromite on contact with aqueous media. Examples include the alkali metal hypochlorites or hypobromites or alkaline earth metal hypochlorites or hypobromites. Examples of such useful bleaches are sodium hypochlorite, potassium hypochlorite, lithium hypochlorite, calcium hypochlorite and magnesium hypochlorite. Sodium hypochlorite is highly desirable because of its ready availability. However, lithium and magnesium hypochlorites are desirably stable.

Particular examples of organic bleaching agents include the dry, particulate heterocyclic N-bromo and N-chloro imides such as trichlorocyanuric, tribromocyanuric acid, dibromo- and dichlorocyanuric acid, the salts thereof with water-solubilizing cations such as potassium and sodium and mixtures thereof. Particular compounds are potassium dichloroisocyanurate and trichloroisocyanuric acids.

Other N-bromo and N-chloro imides may also be used, such as N-brominated and N-chlorinated succinimide, malonimide phthalimide and naphthalimide. Other compounds include the hydantoins, such as 1,3-dibromo and 1,3-dichloro-5,5-dimethyl-hydantoin; N-monochloro-5,5-dimethylhydantoin, methylene-bis(N-bromo-5,5-dimethylhydantoin); 1,3-dichloro,5,methyl-5-N-amylhydantoin, and the like. Other useful hypohalite liberating agents comprise tribromomelamine and trichloromelamine.

Brominated and chlorinated trisodium phosphates formed by the reaction of the corresponding sodium hypohalite solution with trisodium phosphate (and water as necessary) are also useful.

Other bleaching agents are capable of liberating hypochlorite as well as hypobromite such as, for example, the N-brominated, N'-chlorinated heterocyclic imides, as, for example, the N-bromo, N'-chlorocyanuric acids and salts thereof, e.g., N-monobromo-N, N-dichlorocyanuric acid, N-monobromo-N-monochlorocyanuric acid, sodium N-monobromo-N-monochlorocyanurate, potassium-N-monobromo-N-monochlorocyanurate; and the N-brominated, N-chlorinated hydantoins, e.g., N-bromo-N-chloro-5,5-dimethylhydantoin and N-bromo-N-chloro-5-ethyl-5-methyl hydantoin.

The preferred compositions contain a clay thickening agent which may be either naturally occurring or synthetic. A preferred synthetic clay is the one disclosed in U.S. Pat. No. 3,843,548, incorporated herein by reference. Naturally occurring clays include smectite and attapulgite clays.

The clay materials which function in the instant composition as thickening and corrosion protection agents can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonoids) and attapulgites (or palygorskites).

Smectites are three-layered clays. There are two distinct classes of smectite-type clays. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)(OH)_2$, for the aluminum and magnesium oxide type clays, respectively. It is to be recognized that the range of the water of hydration in the above formulas can vary with the processing to which the clay has been subjected. This is immaterial to the use of the smectite clays in the present compositions in that the expandable characteristics of the hydrated clays are dictated by the silicate lattice structure. Furthermore, atom substitution by iron and magnesium can occur within the crystal lattice of the smectites, while metal cations such as $Na^+$, $Ca^{++}$, as well as $H^+$, can be copresent in the water of hydration to provide electrical neutrality. Although the presence of iron in such clay material is preferably avoided to minimize chemical interaction between clay and bleach, such cation substitutions in general are immaterial to the use of the clays herein since the desirable physical properties of the clay are not substantially altered thereby.

The layered expandable aluminosilicate smectite clays useful herein are further characterized by a diotahedral crystal lattice, whereas the expandable magnesium silicate clays have a trioctahedral crystal lattice.

The smectite clays used in the compositions herein are all commercially available. Such clays include, for example, montmorillonite (bentonite), volchonskoite, nontronite, beidellite, hectorite, saponite, sauconite and vermiculite. The clays herein are available under commercial names such as "Fooler Clay" (clay found in a relatively thin vein above the main bentonite or montmorillonite veins in the Black Hills) and various trade names such as Thixogel No. 1 and Gelwhite GP from Georgia Kaolin Company, Elizabeth, New Jersey (both montmorillonites); Volclay BC and Volclay No. 325, from American Colloid Company, Skokie, Illinois; Black Hills Bentonite BH 450, from International Minerals and Chemicals; Veegum Pro and Veegum F, from R. T. Vanderbilt (both hectorites); Barasym NAS-100, Barasym NAH-100, Barasym SMM 200, and Barasym LIH-200, all synthetic hectorites and saponites marketed by Baroid Division, NL, Industries, Inc.

Smectite clays are preferred for use in the instant invention. Montmorillonite, hectorite and saponite are the preferred smectites. Gelwhite GP, Barasym NAS-100 and Barasym NAH-100 are the preferred montmorillonites, hectorites and saponites.

A second type of expandable clay material useful in the instant invention is classified geologically as attapulgite (palygorskite). Attapulgites are magnesium-rich clays having principles of superposition of tetrahedral and octahedral unit cell elements different from the smectites. An idealized composition of the attapulgite unit cell is given as: $(OH_2)_4(OH)_2Mg_5Si_8O_{20}.4H_2O$.

A typical attapulgite analyses yields 55.02% $SiO_2$; 10.24% $Al_2O_3$; 3.53% $Fe_2O_3$; 10.45% MgO; 0.47% $K_2O$; 9.73% $H_2O$ removed at 150° C.; 10.13% $H_2O$ removed at higher temperatures.

Like the smectites, attapulgite clays are commercially available. For example, such clays are marketed under the tradename Attagel, i.e. Attagel 40, Attagel 50 and Attagel 150 from Engelhard Minerals & Chemicals Corporation.

Particularly preferred for the colloid-forming clay component in certain embodiments of the instant composition are mixtures of smectite and attapulgite clays. In general, such mixed clay compositions exhibit increased and prolonged fluidity upon application of shear stress but are still adequately thickened solutions at times when flow is not desired. Clay mixtures in a smectite/attapulgite weight ratio of from 5:1 to 1:5 are preferred. Ratios of from 2:1 to 1:2 are more preferred. A ratio of about 1:1 is most preferred.

As noted above, the clays employed in the compositions of the present invention contain cationic counter ions such as protons, sodium ions, potassium ions, calcium ions, magnesium ions and the like. It is customary to distinguish between clays on the basis of one cation which is predominately or exclusively absorbed. For example, a sodium clay is one which the absorbed cation is predominately sodium. Such absorbed cations can become involved in exchange reactions with cations present in aqueous solutions. It is preferred that the present compositions contain up to about 12% or preferably up to about 8% potassium ions since they improve the viscosity increasing characteristics of the clay. Preferably at least 1%, more preferably at least 2% of the potassium ions are present.

Specific preferred clays are disclosed in U.S. Pat. Nos. 3,993,573 and 4,005,027, incorporated herein by reference. These materials are preferred for thickening. The amount of clay will normally be from about ¼% to about 20%, preferably from about 1% to about 12%.

Other thickening agents which are useful in the process aspect of this invention include those disclosed in U.S. Pat. No. 3,393,153 incorporated herein by reference, including colloidal silica having a mean particle diameter ranging from about 0.01 micron to about 0.05 micron and particulate polymers such as polystyrene, oxidized polystyrene having an acid number of from 20 to about 40, sulfonated polystyrene having an acid number of from about 10 to about 30, polyethylene, oxidized polyethylene having an acid number of from about 10 to about 30; sulfonated polyethylene having an acid number of from about 5 to about 25; polypropylene, oxidized polypropylene having an acid number of from about 10 to about 30 and sulfonated polypropylene having an acid number of from about 5 to about 25, all of said particulate polymers having mean particle diameters ranging from about 0.01 micron to about 30 microns. Other examples include copolymers of styrene with monomers such as maleic anhydride, nitrilonitrile, methacrylic acid and lower alkyl esters of methacrylic acid. Other materials include copolymers of styrene with methyl or ethyl acrylate, methyl or ethyl maleate, vinyl acetate, acrylic maleic or fumaric acids and mixtures thereof. The mole ratio of ester and/or acid to styrene being in the range from about 4 to about 40 styrene units per ester and/or acid unit. The latter materials having a mean particle diameter range of from about 0.05 micron to about 1 micron and molecular weights ranging from about 500,000 to about 2,000,000.

Other bleach stable thickening agents can be used, including carboxypolymethylene, etc.

The viscosity of the composition is from about 100 CPS to about 1,000,000 CPS, preferably from about 500 CPS to about 50,000 CPS. Most preferably the composition is thixotropic.

The preferred compositions of this invention contain from about ½% to about 9%, preferably from about 1% to about 3% of an alkali metal silicate, preferably sodium or potassium silicates, having a ratio of silicon dioxide to alkali metal oxide of greater than about 1, preferably greater than about 1.5, and most preferably greater than about 2. These silicates serve as a source of alkalinity and primarily to improve the corrosion protection of the composition. The clays also contribute to corrosion protection and human safety, including skin mildness and ingestion safety when used with the silicate. Accordingly, even when other thickening agents are used, it is desirable to add at least about 1% clay to improve corrosion protection. Non-expandable clays that do not thicken can also be used as corrosion protection agents.

In addition to the above essential ingredients, it may be desirable to include hypochlorite bleach stable perfumes including those of the types disclosed in U.S. Pat. No. 3,876,551; British Pat. No. 886,084; and U.S. Pat. No. 3,684,722, incorporated herein by reference.

Bleach stable dyes, coloring agents, pigments, opacifiers, etc. can be added in minor amounts. The compositions can also contain a hypochlorite beach stable surface active agent including those of U.S. Pat. No. 3,684,722, incorporated herein by reference, which can also act as a thickening agent and those contained in German patent application No. 2,458,100; U.S. Pat. Nos. 3,876,551; 3,697,431; and 4,005,027; South African Patent Application 70/5875, etc., all of said patents and applications being incorporated herein by reference.

The compositions can contain up to about 10%, preferably from about 0.25% to about 2% by weight of bleach stable surfactant.

The surfactant selected for use in the present compositions must be stable against chemical decomposition and oxidation by the strong active chlorine bleaching agent also essentially present. Accordingly, surfactant materials of the instant invention must contain no functionalities (such as ether linkages, unsaturation, some aromatic structures, or hydroxyl groups) which are susceptible to oxidation by the hypochlorite species found in the present compositions. Thus many of the commonly employed surfactant materials of the prior art, i.e., alkylbenzene sulfonates, olefin sulfonates, alkyl glyceryl ether sulfonates, alkyl ether sulfates and ethoxylated nonionic surfactants are to be avoided in the compositions of the instant invention.

Bleach-stable surfactants which are especially resistant to hypochlorite oxidation fall into two main groups. One such class of bleach-stable surfactants are the watersoluble alkyl sulfates containing from about 8 to 18 carbon atoms in the alkyl group. Alkyl sulfates are the watersoluble salts of sulfated fatty alcohols. They are produced from natural or synthetic fatty alcohols containing from about 8 to 18 carbon atoms. Natural fatty alcohols include those produced by reducing the glycerides of naturally occurring fats and oils. Fatty alcohols can be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, magnesium coconut alkyl sulfate, calcium coconut alkyl sulfate, potassium coconut alkyl sulfate and mixtures of these surfactants. Highly preferred alkyl sulfates are sodium coconut alkyl sulfate, potassium coconut alkyl sulfate, potassium lauryl alkyl sulfate and sodium lauryl alkyl sulfate.

A second class of bleach-stable surfactant materials operable in the instant invention are the water-soluble betaine surfactants. These materials have the general formula:

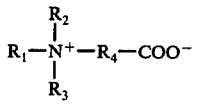

wherein $R_1$ is an alkyl group containing from about 8 to 18 carbon atoms; $R_2$ and $R_3$ are each lower alkyl groups containing from about 1 to 4 carbon atoms, and $R_4$ is an alkylene group selected from the group consisting of methylene, propylene, butylene and pentylene. (Propionate betaines decompose in aqueous solution and are hence not included in the instant compositions.)

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanoate and tetradecyldipropyl ammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

Other desirable bleach stable surfactants are the alkyl phosphonates, taught in the copending U.S. patent application of Ronald L. Jacobsen, Ser. No. 728,579, filed Oct. 1, 1976, incorporated herein by reference.

Some compositions can also contain agents for controlling hardness ions including alkali metal, e.g., sodium or potassium, carbonates, organic polyphosphonate and/or polycarboxylate chelators (e.g., mellitates, polyacrylates, oxylates, tartrates, malonates, adipates, gluconates, and citrates), tripolyphosphates, pyrophosphates, orthophosphates, etc. These materials act as detergency improvers. Desirably the composition will contain little or no phosphorus materials. The materials for controlling hardness ions can be present in amounts up to about 15%, preferably in amounts up to about 10%, most preferably from about 2% to about 6%.

The compositions are adjusted to their proper alkaline level by the addition of an alkali metal, e.g., sodium or potassium hydroxide or carbonate. Preferably a hydroxide is added. The final pH should be from about 9 to about 13, preferably from about 10 to about 12.5.

The remainder of the composition will normally be water, but small amounts of organic solvents such as $C_1$–$C_5$ chlorinated hydrocarbons, such as methylene chloride, can also be added in amounts up to about 10%, preferably from about 1% to about 6%.

The process of this invention is based on the discovery that superior cleaning can be accomplished by applying a thickened, preferably thixotropic, highly alkaline bleach composition to baked-on, hard-to-remove soil and then covering the treated soil with an excess of water, e.g., by filling the pot or pan with water or putting the utensil into water. Surprisingly if the water is at ambient temperature, i.e., 70° F., the advantage is minimal. However, if the water is hotter than 100° F., preferably hotter than 120° F., the amount of work needed to remove the soil is drastically reduced. The temperature is normally lower than boiling, e.g., less than about 210° F.

An additional advantage of the compositions of this invention is the suppression of suds in an automatic dishwasher. when the treated kitchen utensils are added to the dishwasher.

All percentages, parts and ratios herein are by weight unless otherwise specified.

EXAMPLE I

This Example demonstrates the surprising results obtained with the process of this invention. The composition in the following tests contains 3% sodium hypochlorite, 1% of a sodium silicate having an $SiO_2$:$Na_2O$ ratio of about 3.2, 5% potassium carbonate, and 8% of a montmorillonite clay (Gelwhite GP) with the balance being water. This product is thixotropic and has a viscosity of about 2000 CPS and a pH of about 11.3.

In this test, Pyrex and aluminum coupons are treated with eight food soils including egg, oatmeal, pudding, tomato sauce, milk, macaroni and cheese, etc. and then baked to create standard, hard-to-remove soils.

The work necessary to remove the soils is obtained by using a "Gardner Abrasion Machine" using a series of progressively heavier weights. The first ten strokes by the machine are made with a one-pound weight, the next ten strokes are made with a three-pound weight, and the last ten strokes are made with a six-pound weight. The amount of energy required to remove the soil completely is determined by adding the energy used in the total number of strokes required, or if the total of 30 strokes does not remove the soil, the assumption is made that the remaining percentage of the soil will require a proportionately greater amount of energy to remove it.

The different treatments are compared to a first treatment in which the test composition is applied full strength to the soils and allowed to stand for five minutes in 70° F. air, the amount of work necessary for complete soil removal by this treatment was arbitrarily assigned a "work index" of 100.

This compares to a conventional treatment in which a solution of a commercial dishwashing liquid "Joy" at a 0.2% concentration is tested and the work index is much greater, about 300–400. This means three to four times as much "work" is required to remove the soil. When the test product was used full strength on the soils and allowed to stand for 5 minutes in 125° F. air, the work index was 110 indicating that 10% more work was required to remove the soil. When the test procedure was applied to the coupons and then covered with an excess of water at 70° F. for 5 minutes, the work index was 135 indicating 35% more work was required to remove the soil. When the test product was applied to the soil coupons and then covered with an excess of 120° F. water for five minutes, the work index was 60 indicating that only sixty percent of the amount of work was necessary to remove the soil.

In the second set of experiments the same Joy solution treatment is used as the standard with an arbitrarily assigned work index of 100. This is compared with the test product at a 1% level in water with a soak for five minutes to give a work index of 81. It is also compared with 5% and 10% solutions of the test product soaking for five minutes to give work indices of 62 and 55 respectively. This compares with the treatment in which there is a direct application of 2.5 grams (comparable to the amount required to form a 0.25% solution of the test product) with a subsequent application of an excess of 125° F. water and a five minute soak to give a work index of 20 to 25.

As can be seen from the above data, the process of this invention is highly superior to other processes including direct application of the product by itself, application of large amounts of the product in solution and even application of the product in concentrated form followed by covering the treated soil with water at room temperature. In order to obtain the full benefits of the products of this invention and the other similar thickened products disclosed herein, it is necessary that the thickened composition be applied full strength to the soil, followed by covering the treated soil with an excess of water at a temperature of over 100° F.

EXAMPLE II

In this Example, various compositions were compared for their corrosive effect upon standard aluminum coupons immersed in the product at 100% concentration for sixteen hours at 120° F. This test is especially relevant to the desired process of the invention since many kitchen utensils are made of aluminum which is highly susceptible to attack by bleaches, alkalinity, and/or abrasives. The coupons were graded on a scale of from 0 to 10 wherein 0 represents significant destruction with extensive pitting and general corrosion and a grade of 10 indicates complete protection.

A composition containing 3% sodium hypochlorite, 5% potassium carbonate, and the balance water gave a corrosion grade of 0. A second composition containing 3% sodium hypochlorite, 5% potassium carbonate, 8% montomorillonite clay (Gelwhite GP) and the balance water gave a corrosion grade of 0. A third composition containing 3% sodium hypochlorite, 5% potassium carbonate, 3% of a sodium silicate having an $SiO_2$:$Na_2O$ ratio of about 3.2 and the balance water gave a corrosion grade of 7. Finally, a composition, according to the teachings of this invention, containing 3% sodium hypochlorite, 5% potassium carbonate, 3% of a sodium silicate having an $SiO_2$:$Na_2O$ ratio of 3.2, 8% of Gelwhite GP, and the balance water gave a corrosion grade of 9+.

The last composition had a pH of about 11.5 and a viscosity of about 8000 CPS and was thixotropic.

As can be seen from the above data, the preferred compositions of this invention containing clay and sodium silicate are surprisingly superior in their protection of metals.

EXAMPLE III

In this Example, the Joy solution is again used as a standard at a work index of 100%. Using the preferred process in which the concentrated composition is applied to the soils and then excess 120° F. water is applied to the treated surface, the following results are obtained. The first composition contains 4% Gelwhite GP, 3% hypochlorite, 5% potassium carbonate, 3% of sodium silicate wherein the silicon dioxide to sodium oxide ratio is about 3.25 and the balance water and is thixotropic, having a viscosity of about 2000 CPS and a pH of about 11.5. The work index for this composition was 20. A similar composition containing 8% Gelwhite GP, 0.1% sodium hypochlorite, 3% potassium chloride and the balance water has a pH of about 9.5 and a viscosity of about 8000 CPS and gives a work index of 110.

This shows that in order to obtain adequate performance, the compositions must contain adequate hypohalite and have a sufficiently high pH.

EXAMPLE IV

| | |
|---|---|
| Colloidal silica (Aerosil COK 84) (Degussa, Inc.) | 4.0% |
| Gelwhite GP | 0.5% |
| $SiO_2$:$Na_2O$ r = 2.5 | 3.0% |
| NaOCl | 3.0% |
| Water (pH adjusted to 10.5 with NaOH and $H_2SO_4$ as required) | Balance |
| Viscous - Thixotropic; Reduces work index; Provides aluminum protection. | |

EXAMPLE V

| | |
|---|---|
| Sodium carboxypolymethylene (Carbopol 941) (B. F. Goodrich) | 2.0% |
| Kaolin (Kaopaque 10) (Georgia Kaolin) | 1.0% |
| $SiO_2$:$Na_2O$ r = 2.0 | 5.0% |
| KOCl | 3.5% |
| Water (pH adjusted to 11.0 with $H_2SO_4$ NAOH as required) | Balance |
| Viscous - Non-thixotropic; Reduces work index; Provides aluminum protection. | |

EXAMPLE VI

| | |
|---|---|
| Bentonite treated with a quaternary ammonium compound (Bentone 34) (N. L. Industries) | 6.0% |
| $SiO_2$:$K_2O$ r = 2.5 | 5.0% |
| $K_2CO_3$ | 8.0% |
| NaOCl | 2.0% |
| Water (pH adjusted as required with $H_2SO_4$ and KOH to 12) | Balance |
| Viscous - Thixotropic; Reduces work index; provides aluminum protection. | |

EXAMPLE VII

| | |
|---|---|
| Gelwhite GP | 8.0% |
| $SiO_2$:$Na_2O$ r = 3.2 | 3.0% |
| $K_2CO_3$ | 5.0% |
| KDCC (Potassium dichloro cyanurate) | 5.0% |
| Water (pH adjusted to 11.5 with KOH and $H_2SO_4$ as required) | Balance |
| Viscous - Thixotropic; Reduces work index; Provides aluminum protection. | |

EXAMPLE VIII

| | |
|---|---|
| Gelwhite GP | 4.0% |
| $SiO_2$:$Na_2O$ r = 3.2 | 3.0% |
| $K_2CO_3$ | 5.0% |
| NaOCl | 3.0% |
| Sodium $C_{14-16}$ *paraffin sulfonate* | 1.0% |
| Water (pH adjusted to 11.5 with $H_2SO_4$ and NaOH as required) | Balance |
| Viscous - Thixotropic; Reduces work index; Provides aluminum protection. | |

EXAMPLE IX

| | |
|---|---|
| Bentone 34 | 6.0% |
| $SiO_2$:$Na_2O$ r = 3.2 | 5.0% |
| $K_2CO_3$ | 7.0% |
| NaOCl | 3.0% |
| Methylene chloride | 6.0% |
| Water (pH adjusted to 11.8 with NaOH and $H_2SO_4$ as required) | Balance |
| Viscous - Thixotropic; Reduces work index; Provides aluminum protection. | |

EXAMPLE X

| | |
|---|---|
| Carbopol 941 | 2.0% |
| Bentone 34 | 0.5% |
| $SiO_2$:$Na_2O$ r = 2.5 | 3.0% |
| NaDCC | 5.0% |
| Na Citrate | 8.0% |
| Water (pH adjusted to 11.0 with NaOH and $H_2SO_4$ as required) | Balance |
| Viscous - Non-thixotropic; Reduces work index; Provides aluminum protection. | |

EXAMPLE XI

| | |
|---|---|
| Gelwhite GP | 4.0% |
| $SiO_2$:$Na_2O$ r = 3.2 | 3.0% |
| $K_2CO_3$ | 5.0% |
| NaOCl | 3.0% |
| Potassium orthophosphate | 3.0% |
| Water (pH adjusted to 11.0 with $H_2SO_4$ and KOH as required) | Balance |

EXAMPLE XII

| | |
|---|---|
| Gelwhite GP | 4.0% |
| $SiO_2$:$Na_2O$ r = 3.2 | 3.0% |
| $K_2CO_3$ | 5.0% |
| NaOCl | 3.0% |
| Potassium coconut alkyl sulfate | 1.0% |
| Water (pH adjusted to 11.5 with $H_2SO_4$ and KOH as required) | Balance |
| Viscous - Thixotropic; Reduces work index; Provides aluminum protection. | |

EXAMPLE XIII

| | |
|---|---|
| Gelwhite GP | 4.0% |
| $SiO_2$:$Na_2O$ r = 3.2 | 3.0% |
| $K_2CO_3$ | 5.0% |
| NaOCl | 3.0% |
| Coconut alkyl dimethyl ammonium acetate | 1.0% |
| Water (pH adjusted to 11.5 with $H_2SO_4$ and KOH as required) | Balance |
| Viscous - Thixotropic; Reduces work index; Provides aluminum protection. | |

EXAMPLE XIV

| | |
|---|---|
| Gelwhite GP | 4.0% |
| $SiO_2$:$Na_2O$ r = 3.2 | 3.0% |
| $K_2CO_3$ | 5.0% |
| NaOCl | 3.0% |
| Potassium randomly phosphonated octadecene | 1.0% |
| Water (pH adjusted to 11.5 with $H_2SO_4$ and KOH as required) | Balance |
| Viscous - Thixotropic; Reduces work index; Provides aluminum protection. | |

EXAMPLE XV

| | |
|---|---|
| Gelwhite GP | 4.0% |
| $SiO_2$:$Na_2O$ r = 3.2 | 3.0% |
| $K_2CO_3$ | 5.0% |
| Sodium para-toluene sulfonchloramine | 10.0% |
| Sodium $C_{14-16}$ paraffin sulfonate | 1.0% |
| Water (pH adjusted to 11.5 with $H_2SO_4$ and NaOH as required) | Balance |
| Viscous - Thixotropic; Reduces work index; Provides aluminum protection. | |

What is claimed is:

1. An alkaline, aqueous, liquid composition which is free of abrasives, having a pH of from about 9 to about 13, consisting essentially of:

(a) from about ¼% to about 20% of a clay thickening and corrosion protection agent selected from the group consisting of smectite and attapulgite clays and mixtures thereof, (b) from about ½% to about 9% of an alkali metal silicate having an $SiO_2$:$M_2O$ ratio greater than about 1 wherein M is selected from the group consisting of sodium and potassium, (c) a hypohalite liberating bleach component selected from the group consisting of alkali metal and alkaline earth metal hypochlorites and hypobromites, heterocyclic N-bromo and N-chloro imides and mixtures thereof, said hypohalite liberating bleach component being at a concentration to provide an available halogen level of from about ½% to about 10%, (d) from 0% to about 10% of a bleach stable surfactant selected from the group consisting of alkyl sulfate salts containing from about 8 to about 18 carbon atoms in the alkyl group and water-soluble betaine surfactants having the general formula:

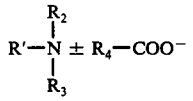

wherein $R_1$ is an alkyl group containing from about 8 to 18 carbon atoms, $R_2$ and $R_3$ are each alkyl groups containing from 1 to about 4 carbon atoms and $R_4$ is an alkylene group selected from the group consisting of methylene, propylene, butylene and pentylene, (e) from 0% to about 15% of detergency improvers selected from the group consisting of alkali metal carbonates, polyphosphonates, polycarboxylates, phosphates and mixtures thereof, and (f) from 0% to about 10% methylene chloride, and (g) the remainder water, said composition having a viscosity of from about about 100 CPS to about 1,000,000 CPS.

2. The composition of claim 1 having an available halogen level of from about 1% to about 6%.

3. The composition of claim 1 having an available halogen level of from about 2% to about 5%.

4. The composition of claim 1 wherein the clay thickening and corrosion protection agent is a smectite clay.

5. The composition of claim 4 containing from about 1% to about 12% of a smectite clay thickening and corrosion protection agent which is selected from the group consisting of montmorillonite, volchonskoite, nontrionite, hectorite, saponite, sauconite, vermiculite and mixtures thereof.

6. The composition of claim 1 wherein the alkali metal silicate has an $SiO_2$:$M_2O$ ratio greater than about 2 and is present in an amount from about 1% to about 3%.

7. The composition of claim 6 wherein the clay thickening agent is selected from the group consisting of smectite and attapulgite clays.

8. The composition of claim 7 wherein the clay thickening agent is a smectite clay.

9. The composition of claim 7 containing from about 1% to about 12% of a smectite clay thickening and corrosion protection agent which is selected from the group consisting of montmorillonite, volchonskoite, nontrionite, hectorite, saponite, sauconite, vermiculite and mixtures thereof.

10. A process for cleaning hard-to-remove soils from kitchen utensils in which (1) an alkaline, aqueous liquid hypohalite composition consisting essentially of:

(a) a hypohalite-liberating bleach component selected from the group consisting of alkali metal and alkaline earth metal hypochlorites and hypobromites, heterocyclic N-bromo and N-chloroimides and mixtures thereof, said hypohalite-liberating bleach component being at a concentration to provide an available halogen level of from about 1% to about 10%, and (b) a bleach stable thickening agent selected from the group consisting of: (i) smectite and attapulgite clays, (ii) colloidal silica, (iii) carboxypolymethylene, (iv) particulate polymers with a mean particle diameter of from about 0.01 micron to about 30 microns selected from the group consisting of polystryene, oxidized polystyrene having an acid number of from 20 to about 40, sulfonated polystyrene having an acid number of from about 10 to about 30, polyethylene, oxidized polyethylene having an acid number of from about 10 to about 30; sulfonated polyethylene having an acid number of from about 5 to about 25; polypropylene, oxidized polypropylene having an acid number of from about 10 to about 30 and sulfonated polypropylene having an acid number of from about 5 to about 25, said particulate polymers having mean particle diameters ranging from about 0.01 micron to about 30 microns, and (v) copolymers of styrene with maleic anhydride, nitrilonitrile, methacrylic acid, methyl or ethyl esters of methacrylic acid, copolymers of styrene with methyl or ethyl acrylate, methyl or ethyl maleate, vinyl acetate, acrylic acid, maleic acid, fumaric acid, and mixtures thereof, the mole ratio of ester or acid to styrene being in the range from about 4 to about 40 styrene units per ester or acid unit, said styrene copolymer having a mean particle diameter of from about 0.05 micron to about 1 micron and a molecular weight of from about 500,000 to about 2,000,000, said composition having a viscosity of from about 100 CPS to about 1,000,000 CPS and a pH of from about 9 to about 12, is applied to said soils and (2) said soils are then covered with an excess of water having a temperature of more than about 100° F.

11. The process of claim 10 wherein the hypohalite is hypochlorite at a concentration to give available chlorine level of from about 1% to about 6%, the viscosity of the hypochlorite composition is between about 500 CPS and about 50,000 CPS, said composition is thixotropic, the pH of said composition is from about 10 to about 12.5, and said composition contains an alkali metal silicate in an amount from about 1% to about 3%, said alkali metal silicate having a silicon dioxide to alkali metal oxide ratio of more than about 2.

* * * * *